US005518117A

United States Patent [19]

Eriksen

[11] Patent Number: 5,518,117

[45] Date of Patent: May 21, 1996

[54] CARRYING DEVICE FOR GABLE-TOP CARTONS

[75] Inventor: Sverre Eriksen, Hallingby, Norway

[73] Assignee: Norpapp Industri A/S, Norway

[21] Appl. No.: 325,306

[22] PCT Filed: Apr. 29, 1993

[86] PCT No.: PCT/NO93/00069

§ 371 Date: Nov. 3, 1994

§ 102(e) Date: Nov. 3, 1994

[87] PCT Pub. No.: WO93/22218

PCT Pub. Date: Nov. 11, 1993

[30] Foreign Application Priority Data

May 6, 1992 [NO] Norway ..... 921797

[51] Int. Cl.[6] ..... B65D 65/00; B66C 1/10; B65B 21/10

[52] U.S. Cl. ..... 206/431; 53/443; 294/87.2

[58] Field of Search ..... 206/431, 142, 206/199, 197; 294/87.2, 159; 53/443

[56] References Cited

U.S. PATENT DOCUMENTS

| | | | |
|---|---|---|---|
| 2,514,858 | 7/1950 | Gray . | |
| 2,675,264 | 4/1954 | Vander Lugt, Jr. | 294/87.2 |
| 2,696,401 | 12/1954 | Church et al. . | |
| 2,713,508 | 7/1955 | Austin | 294/87.2 |
| 2,819,793 | 1/1958 | Lamb . | |
| 2,822,208 | 2/1958 | Then | 294/87.2 |
| 2,846,063 | 8/1958 | Fahrenbach | 206/431 |
| 3,653,503 | 4/1972 | Arneson . | |
| 3,829,143 | 8/1974 | Bird . | |
| 3,900,103 | 8/1975 | Day | 206/431 |
| 4,946,037 | 8/1990 | Keith . | |

FOREIGN PATENT DOCUMENTS

| | | |
|---|---|---|
| 107749 | 12/1962 | Norway . |
| 333329 | 3/1971 | Sweden . |
| 360331 | 9/1973 | Sweden . |

*Primary Examiner*—Bryon P. Gehman
*Attorney, Agent, or Firm*—Pollock, Vande Sande & Priddy

[57] ABSTRACT

A carrying device for a number of gable-top cartons with holes (14) for holding the closing part of the gable-top cartons and with a hand-grip opening (10). Each of the holes of the carrying device for the closing parts of the gable-top carton has a shape that is approximately equal to the shape of the gable-top cartons at the closing part, and is surrounded by flaps (11, 12, 13). The flaps are pressed upwards when the carrying device is brought into position on the closing parts of the gable-top cartons, which flaps (13) may be folded backwards in relation to flaps (12), whereafter flaps (12, 13) may be pushed into the approximately tetrahedral hollow in the closing part of the gable-top cartons and thereby hold the gable-top cartons firmly in place at two of their lateral edges.

11 Claims, 2 Drawing Sheets

CARRYING DEVICE FOR GABLE-TOP CARTONS

BACKGROUND OF THE INVENTION

1. Technical Field

The present invention relates to a carrying sheet with room for a number of so-called gable-top cartons.

2. Description of Prior Art

During recent years it has become increasingly difficult to package liquid products such as milk, juice, yogurt, and the like, in so-called gable-top cartons. These gable-top cartons are usually transported to the place of sale in specially constructed boxes. After the products have been sold/consumed, the store/large-scale consumer is left with a large number of bulky, empty boxes. A solution to this problem is to use a carrying device for a number of gable-top cartons, made from cardboard or similar material, to be disposed of after use.

SUMMARY OF THE INVENTION

In order to make the handling of these gable-top cartons simpler and to prepare special sales drives, one objective of the present invention is to provide a cheap device that ties together several gable-top cartons, and that is easy to carry. It is also desirable to have a flat top, so that several layers can be stacked on top of each other. It must be possible to place the multi-package in a fully automatic production line, and it must be easy to open by means of a tear strip.

According to the invention, this is achieved through a carrying device for gable-top cartons having a hole for holding the closing part of the gable-top cartons, and having a hand-grip opening wherein the hole of the carrying device for the carton's closing parts is cut from a flat sheet of corrugated cardboard. Each of these holes have a shape that is approximately equal to the shape of the gable-top carton at the closing part, and are surrounded by flaps that are pressed upwards when the carrying device is brought into position on the closing parts of the gable-top carton. These flaps may be folded backwards in relation to the flaps, whereafter the flaps may be pushed into the tetrahedral hollow of the gable-top carton, in the closing part, and thereby hold in place the gable-top cartons at two of their lateral edges.

The carrying device may be made from double corrugated cardboard, i.e., a corrugated layer, which has a paper layer glued to both sides, possibly a corrugated layer with an interlying paper layer and paper layers glued to both outer layers.

When placing the carrying device on the gable-top cartons, the sheet section is fastened on the underside of the sheet section through gluing or stapling.

One of the sheet sections may possibly have a width that approximately corresponds to the upper sheet section, that has a hand-grip hole equal to the hole of the upper sheet section, so that an unpunched part of the hand-grip hole may be bent down into the corresponding hole in the lower sheet section for holding this firmly in place.

BEST AND VARIOUS MODES FOR CARRYING OUT THE INVENTION

Figure 1:
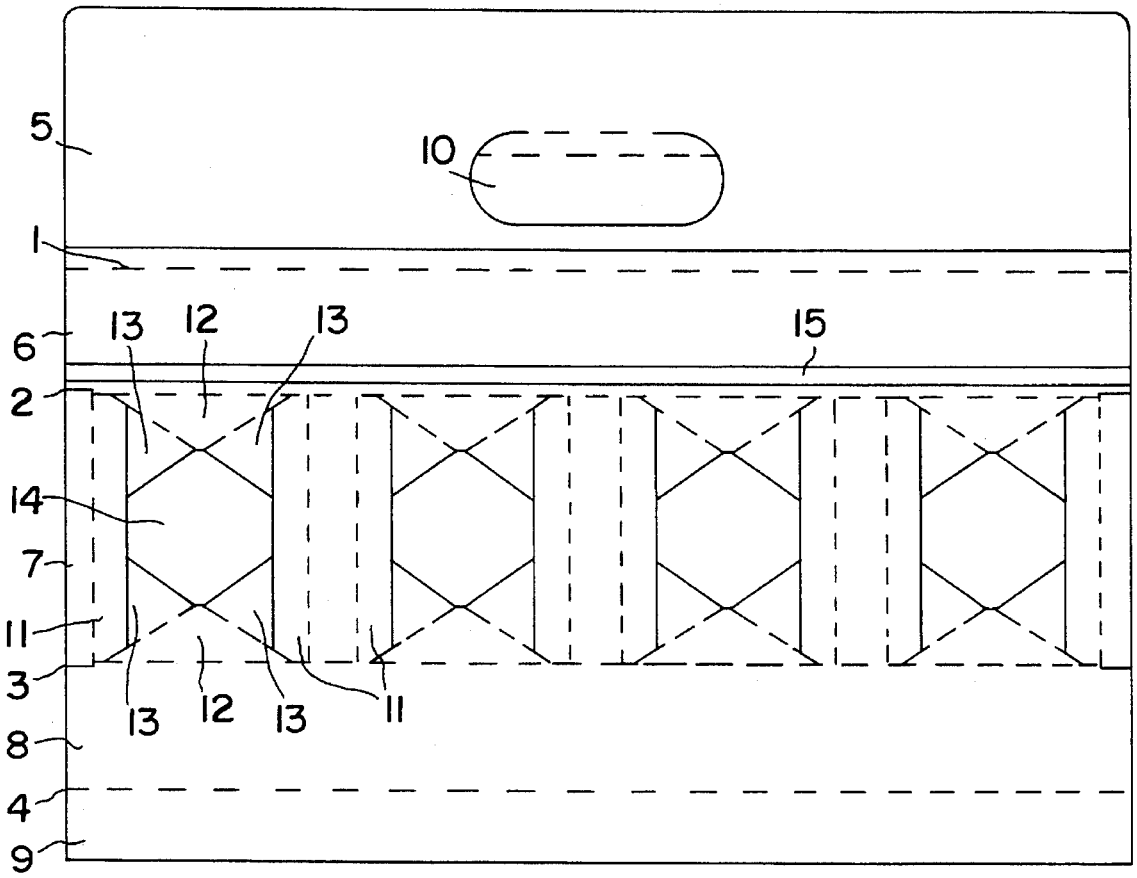
FIG. 1 is a plain view of the blank form of the carrying device of the present invention.
Figure 2B:
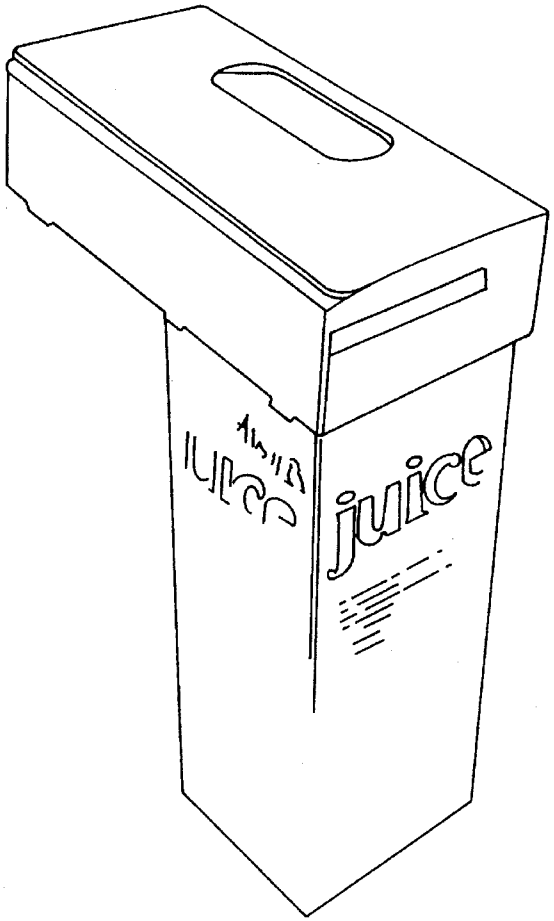
FIG. 2B is an isometric view of the carrying case of the present invention embracing a gable-top carton.
Figure 2A:
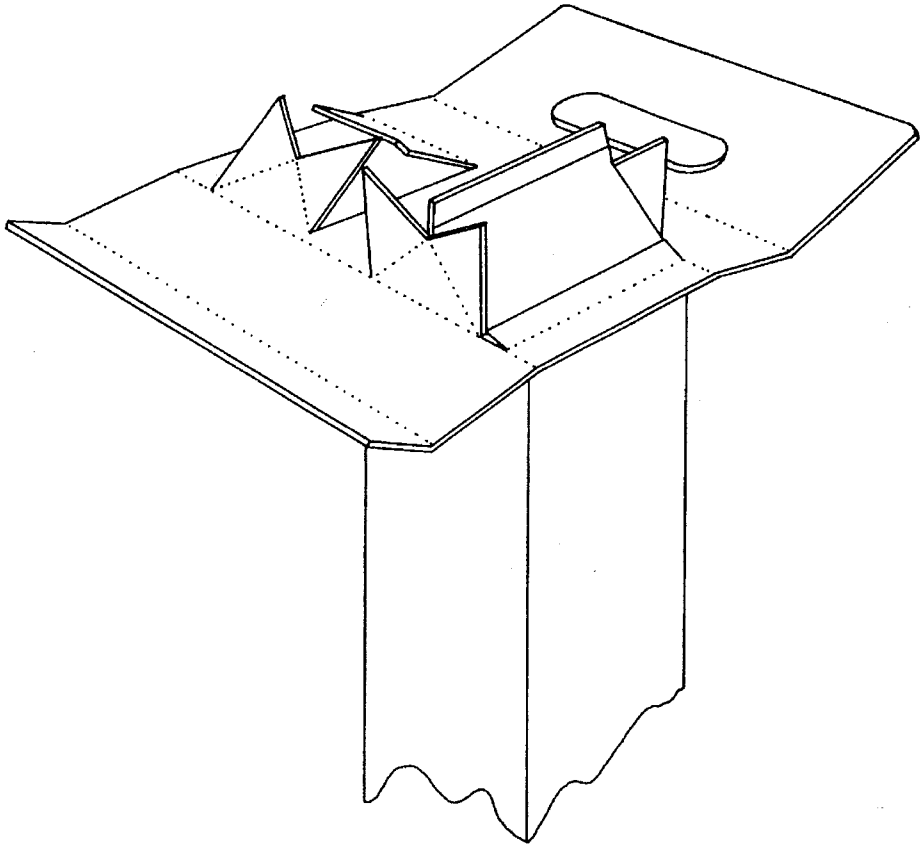
FIG. 2A is a fragmentary isometric view of the carrying device of the present invention partially folded embracing a gable-top carton.

In the following the invention will be described in more detail by means of an illustrated embodiment of a carrying sheet in plain view (see FIG. 1), with room for four gable-top cartons. In the figures, the folding lines are indicated with dotted lines, whereas intersections are indicated with solid lines. The carrying sheet comprises four folding lines 1, 2, 3 and 4 in the entire longitudinal direction of the plate, which divide the sheet in five sections 5, 6, 7, 8 and 9. In the first section 5, which will be located uppermost when the carrying sheet is mounted on the gable-top cartons, as shown in FIG. 2A, there is arranged a partly cut oblong hole 10, which will serve as a carrying handle during use. The folding-line 1 separates section 5 and 6. Section 6 together with section 8 will make up the lateral surfaces of the mounted and folded carrying plate. The width of section 6 and 8 is approximately equal to the height of the folded closing part of the gable-top cartons. On section 6 there is arranged a so-called tear strip 15, which makes the carrying sheet easy to open. The folding lines 2 and 3 define section 7, with cut-outs so that section 7 may be tread down over the closing part of the gable-top carton. All cut-outs in section 7 have the same dimensions. When the carrying sheet is mounted on the gable-top carton, flaps 11, 12 and 13 will be pushed up, as shown in two stages in FIG. 2. When flaps 12 and 13 are approximately vertical, i.e., approximately parallel with the longitudinal axis of the gable-top carton, flap 12 is pushed into the approximately tetrahedral hollow in the gable-top carton. Flaps 13 will then be bent backwards until they meet, and may then easily be pushed into the approximately tetrahedral hollow in the gable-top carton. By means of flaps 11, 12 and 13, the carrying sheet is locked to the gable-top carton, and the carrying sheet is folded along the folding lines 1, 2, 3 and 4. The carrying sheet will then have a shape as shown in FIG. 2B. Finally, section 9 is fastened to section 5 in a suitable manner, for instance through gluing or stapling. It may also be that section 9 has an approximately equal width as section 5, and that section 9 has a an oblong, cut-out hole, corresponding to section 5. By folding down the unpunched portion of hole 10, section 5 and 9 will lock together, so that further fastening is unnecessary.

In the detailed description of the invention there is described a carrying sheet with room for four gable-top cartons; however, this number may differ from four. With a carrying sheet with room for a different number of gable-top cartons, the oblong hole 10 will likewise be shifted, so that the symmetric center of the hole all the time is located at the symmetric axis of the carrying plate.

I claim:

1. A carrying device for carrying a plurality of gable-top cartons, each of the gable-top cartons having a closing part and lateral edges, the closing part including two approximately tetrahedral hollows, said carrying device formed from a plane sheet of corrugated cardboard and comprising:

a plurality of holes provided in said plane sheet, each of said holes being adapted to hold a closing part of one of the gable-top cartons, each of said holes having a shape approximately corresponding to a shape of the closing part of one of the gable-top cartons;

a plurality of flaps secured to said plane sheet and surrounding each of said holes, said flaps being adapted to press upwards when said carrying device is mounted on the closing parts of the gable-top cartons, selected ones of said flaps may be folded away from immediately adjacent ones of said plurality of flaps, whereafter said selected flaps and said adjacent flaps may be pushed into the approximately tetrahedral hollows in the closing parts of the gable-top cartons to thereby hold the gable-top cartons in place at two opposed lateral edges of each carton; and a hand-grip opening provided in said plane sheet.

2. A carrying device according to claim 1, further comprising:

an upper longitudinal sheet section that includes said hand-grip opening and a fold line in its entire longitudinal direction; and a lower longitudinal sheet section that includes a fold line in its entire longitudinal direction;

wherein when said carrying device is mounted on the gable-top cartons, said lower sheet section is fastened into an underside of said upper sheet section through one of gluing and stapling.

3. A carrying device according to claim 2, wherein said lower sheet section has a width approximately equal to said upper sheet section and further includes a hand-grip opening corresponding to the hand-grip opening of said upper sheet section, so that an unpunched portion of said hand-grip opening in said upper sheet section is capable of being bent down into the corresponding hand-grip opening in said lower sheet section for holding it in place.

4. A carrying device according to claim 1, wherein said hand-grip opening is oblong and its symmetric center is located at a symmetric axis of the carrying device.

5. A carrying device according to claim 1, wherein said selected flaps and said adjacent flaps are triangular-shaped.

6. A package, comprising:

a plurality of gable-top cartons, each of said cartons including a gable-top closing part and lateral edges, said closing part including two approximately tetrahedral hollows; and a carrying device, said carrying device being formed from a plane sheet of corrugated cardboard and including:

a plurality of holes provided in said plane sheet, each of said holes being adapted to hold a closing part of one of said gable-top cartons, each of said holes having a shape approximately corresponding to a shape of said closing part of one of said gable-top cartons;

a plurality of flaps secured to said plane sheet and surrounding each of said holes, said flaps being adapted to press upwards when said carrying device is mounted on said closing parts of said gable-top cartons, selected ones of said flaps are folded away from immediately adjacent ones of said flaps, whereafter said selected flaps and said adjacent flaps are pushed into the approximately tetrahedral hollows in said closing parts of said gable-top cartons to thereby hold said gable-top cartons in place at two of said lateral edges of each carton; and a hand-grip opening provided in said plane sheet.

7. A package according to claim 6, wherein said carrying device further includes:

an upper longitudinal sheet section that includes said hand-grip opening and a fold line in its entire longitudinal direction; and a lower longitudinal sheet section that includes a fold line in its entire longitudinal direction;

wherein when said carrying device is mounted on said gable-top cartons, said lower sheet section is fastened into an underside of said upper sheet section through one of gluing and stapling.

8. A package according to claim 6, wherein said lower sheet section has a width approximately equal to said upper sheet section and further includes a hand-grip opening corresponding to the hand-grip opening of said upper sheet section, so that an unpunched portion of said hand-grip opening in said upper sheet section is capable of being bent down into the corresponding hand-grip opening in said lower sheet section for holding it in place.

9. A package according to claim 6, wherein the hand-grip opening is oblong and its symmetric center is located at a symmetric axis of the carrying device.

10. A package according to claim 6, wherein said selected flaps and said adjacent flaps are triangular-shaped.

11. A method for fabricating a package, the package comprising a plurality of gable-top cartons, each of said cartons including a gable-top closing part and lateral edges, said closing part including two approximately tetrahedral hollows; and a carrying device, said carrying device being formed from a plane sheet of corrugated cardboard and including: a plurality of holes provided in said plane sheet, each of said holes being adapted to hold a closing part of one of said gable-top cartons, each of said holes having a shape approximately corresponding to a shape of said closing part of one of said gable-top cartons; a plurality of flaps secured to the plane sheet surrounding each of said holes, said flaps being adapted to press upwards when said carrying device is mounted on said closing parts of said gable-top cartons, selected ones of said flaps are folded away from immediately adjacent flaps, whereafter said selected flaps and said adjacent flaps are pushed into the approximately tetrahedral hollows in said closing parts of said gable-top cartons to thereby hold said gable-top cartons in place at two opposed lateral edges of each carton; and a hand-grip opening provided in said plane sheet, said method comprising the steps of:

placing said carrying device on said closing parts of said gable-top cartons;

pressing all of said flaps that surround each of said holes upwardly;

folding said selected flaps away from said adjacent flaps; and pushing said selected flaps and said adjacent flaps into said approximately tetrahedral hollows in said closing part to thereby hold said gable-top cartons at two opposed lateral edges of each of said cartons in place.

* * * * *